US008708659B2

(12) United States Patent
Tryon et al.

(10) Patent No.: US 8,708,659 B2
(45) Date of Patent: Apr. 29, 2014

(54) TURBINE ENGINE COMPONENT HAVING PROTECTIVE COATING

(75) Inventors: Brian S. Tryon, Glastonbury, CT (US); Darryl Stolz, Newington, CT (US); Paul L. Reynolds, Tolland, CT (US); John J. Schirra, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 737 days.

(21) Appl. No.: 12/890,096

(22) Filed: Sep. 24, 2010

(65) Prior Publication Data

US 2012/0076662 A1 Mar. 29, 2012

(51) Int. Cl.

| | |
|---|---|
| ***F01D 5/14*** | (2006.01) |
| ***F01D 5/02*** | (2006.01) |
| ***F01D 5/28*** | (2006.01) |
| ***F01D 25/00*** | (2006.01) |
| *F01D 5/30* | (2006.01) |

(52) U.S. Cl.

CPC *F01D 5/022* (2013.01); *F01D 5/28* (2013.01); *F01D 5/288* (2013.01); *F01D 5/3007* (2013.01); *F01D 25/005* (2013.01); *F05C 2201/90* (2013.01)

USPC ..... 416/241 R; 416/219 R; 415/200

(58) Field of Classification Search

CPC ..... F01D 5/022; F01D 5/28; F01D 5/288; F01D 5/3007; F01D 25/005; F05C 2201/90

USPC ..... 416/241 R; 415/200

See application file for complete search history.

(56) References Cited

U.S. PATENT DOCUMENTS

| | | | | |
|---|---|---|---|---|
| 3,145,287 | A | | 8/1964 | Siebein et al. |
| 4,321,311 | A | | 3/1982 | Strangman |
| 4,518,442 | A | | 5/1985 | Chin |
| 4,532,191 | A | | 7/1985 | Humphries |
| 4,680,199 | A | | 7/1987 | Vontell et al. |
| 4,719,080 | A | * | 1/1988 | Duhl et al. ..... 420/443 |
| 4,774,149 | A | | 9/1988 | Fishman |
| 4,865,252 | A | | 9/1989 | Rotolico et al. |
| 5,059,095 | A | | 10/1991 | Kushner et al. |
| 5,071,059 | A | | 12/1991 | Heitman et al. |
| 5,141,821 | A | | 8/1992 | Lugscheider et al. |

(Continued)

FOREIGN PATENT DOCUMENTS

| | | |
|---|---|---|
| EP | 0688886 A1 | 12/1995 |
| EP | 1394278 | 3/2004 |

(Continued)

OTHER PUBLICATIONS

European Search Report dated Nov. 14, 2011.

*Primary Examiner* — Igor Kershteyn

(74) *Attorney, Agent, or Firm* — Carlson, Gaskey & Olds, P.C.

(57) ABSTRACT

A turbine engine apparatus includes a structural component made of a superalloy material. A protective coating is disposed on the structural component and has a composition that consists essentially of up to 30 wt % cobalt, 5-40 wt % chromium, 7.5-35 wt % aluminum, up to 6 wt % tantalum, up to 1.7 wt % molybdenum, up to 3 wt % rhenium, up to 5 wt % tungsten, up to 2 wt % yttrium, 0.05-2 wt % hafnium, 0.05-7 wt % silicon, 0.01-0.1 wt % zirconium, and a balance of nickel.

25 Claims, 1 Drawing Sheet

(56) References Cited

U.S. PATENT DOCUMENTS

| | | | | |
|---|---|---|---|---|
| 5,261,940 | A | 11/1993 | Berczik | |
| 5,268,045 | A | 12/1993 | Clare | |
| 5,942,337 | A * | 8/1999 | Rickerby et al. | 428/623 |
| 6,066,405 | A * | 5/2000 | Schaeffer | 416/241 R |
| 6,365,222 | B1 | 4/2002 | Wagner et al. | |
| 6,368,727 | B1 | 4/2002 | Ritter et al. | |
| 6,410,159 | B1 | 6/2002 | Hermanck | |
| 6,434,876 | B1 | 8/2002 | Wheat et al. | |
| 6,444,259 | B1 | 9/2002 | Subramanian et al. | |
| 6,475,642 | B1 | 11/2002 | Zhao et al. | |
| 6,491,208 | B2 | 12/2002 | James et al. | |
| 6,521,293 | B1 | 2/2003 | Kojima et al. | |
| 6,592,947 | B1 | 7/2003 | McCane et al. | |
| 6,706,241 | B1 * | 3/2004 | Baumann et al. | 420/448 |
| 6,780,458 | B2 | 8/2004 | Seth et al. | |
| 6,838,191 | B1 | 1/2005 | Raj | |
| 6,905,728 | B1 | 6/2005 | Hu et al. | |
| 6,964,791 | B2 | 11/2005 | Zhao et al. | |
| 7,273,662 | B2 * | 9/2007 | Gleeson et al. | 428/680 |
| 7,326,441 | B2 * | 2/2008 | Darolia et al. | 427/328 |
| 7,364,801 | B1 | 4/2008 | Hazel et al. | |
| 7,378,132 | B2 | 5/2008 | Renteria et al. | |
| 7,604,867 | B2 | 10/2009 | Hazel et al. | |
| 2002/0005233 | A1 | 1/2002 | Schirra et al. | |
| 2002/0066770 | A1 | 6/2002 | James et al. | |
| 2002/0102360 | A1 | 8/2002 | Subramanian et al. | |
| 2002/0187336 | A1 * | 12/2002 | Khan et al. | 428/323 |
| 2003/0126800 | A1 | 7/2003 | Seth et al. | |
| 2004/0037654 | A1 | 2/2004 | Peterson et al. | |
| 2004/0079648 | A1 | 4/2004 | Khan et al. | |
| 2004/0082069 | A1 | 4/2004 | Jiang et al. | |
| 2004/0086635 | A1 | 5/2004 | Grossklaus, Jr. et al. | |
| 2004/0091627 | A1 | 5/2004 | Ohara et al. | |
| 2004/0126499 | A1 | 7/2004 | Heinrich et al. | |
| 2004/0202885 | A1 | 10/2004 | Seth et al. | |
| 2005/0220995 | A1 | 10/2005 | Hu et al. | |
| 2006/0045785 | A1 | 3/2006 | Hu et al. | |
| 2006/0219329 | A1 | 10/2006 | Hu et al. | |
| 2006/0219330 | A1 | 10/2006 | Hu et al. | |
| 2007/0128363 | A1 | 6/2007 | Rice et al. | |
| 2008/0080978 | A1 | 4/2008 | Zimmerman et al. | |
| 2009/0035601 | A1 | 2/2009 | Litton et al. | |
| 2009/0041615 | A1 | 2/2009 | James et al. | |
| 2010/0078308 | A1 | 4/2010 | Bruce et al. | |

FOREIGN PATENT DOCUMENTS

| | | |
|---|---|---|
| EP | 1398394 A1 | 3/2004 |
| EP | 1795621 | 6/2007 |
| EP | 1795706 | 6/2007 |
| EP | 2006402 | 12/2008 |
| GB | 2243841 | 11/1991 |

* cited by examiner

TURBINE ENGINE COMPONENT HAVING PROTECTIVE COATING

BACKGROUND

This disclosure relates to protective metallic coatings on structural components.

Metallic coatings are often used to protect airfoils from environmental conditions, such as to resist oxidation. The metallic coatings may also serve as a bond coat for adhering topcoat layers of ceramic coatings or other barrier materials. Metallic coatings are normally not used for structural components formed from superalloys, such as disks that are used to mount blades. Disks may be exposed to higher stresses than airfoils, while still operating in aggressive environmental conditions (e.g. oxidation and hot corrosion). As such, disk alloys are made of different superalloy materials than airfoils to enhance environmental durability without debiting disk mechanical performance (e.g., fatigue). Application of traditional environmental coatings to disks can severely debit the disk fatigue capability.

SUMMARY

An example turbine engine apparatus includes a structural component made of a superalloy material. A protective coating is disposed on the structural component and has a composition that consists essentially of up to 30 wt % cobalt, 5-40 wt % chromium, 7.5-35 wt % aluminum, up to 6 wt % tantalum, up to 1.7 wt % molybdenum, up to 3 wt % rhenium, up to 5 wt % tungsten, up to 2 wt % yttrium, 0.05-2 wt % hafnium, 0.05-7 wt % silicon, 0.01-0.1 wt % zirconium, and a balance of nickel.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
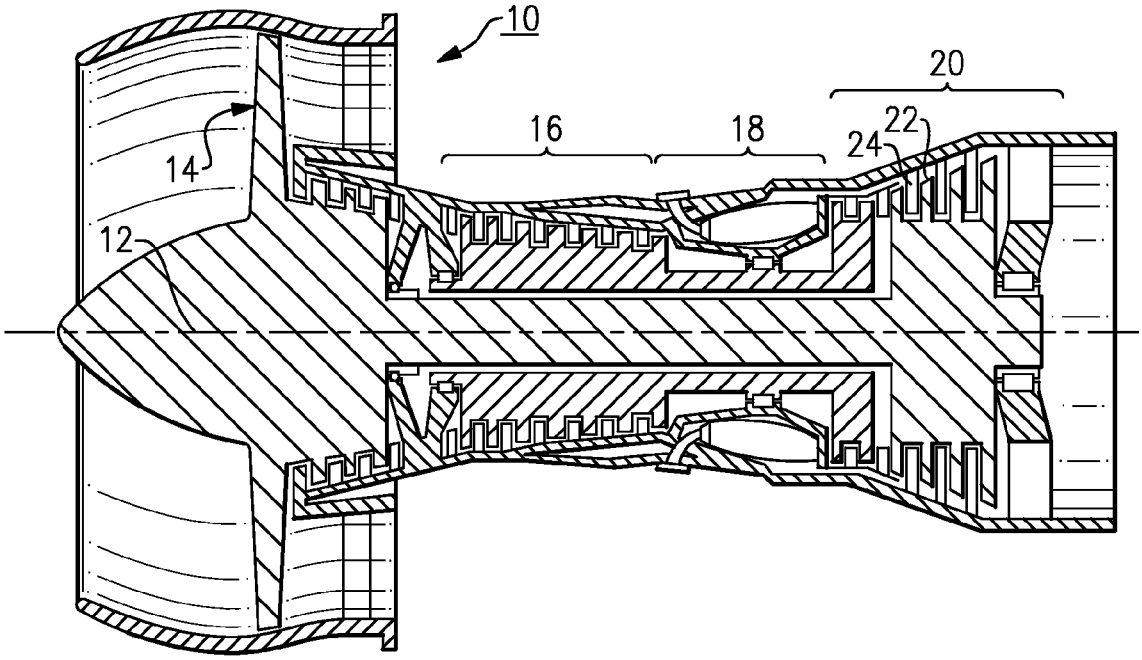
FIG. 1 illustrates an example gas turbine engine.

FIG. 1 illustrates selected portions of an example turbine engine 10, such as a gas turbine engine 10 used for propulsion. In this example, the gas turbine engine 10 is circumferentially disposed about an engine centerline 12. The engine 10 in this example includes a fan 14, a compressor section 16, a combustion section 18, and a turbine section 20 that includes turbine blades 22 and turbine vanes 24. As is known, air compressed in the compressor section 16 is mixed with fuel that is burned in the combustion section 18 to produce hot gases that are expanded in the turbine section 20 to drive the fan 14 and compressor. FIG. 1 is a somewhat schematic presentation for illustrative purposes only and is not a limitation on the disclosed examples. Additionally, there are various types of turbine engines, many of which could benefit from the examples disclosed herein, which are not limited to the design shown.

Figure 2:
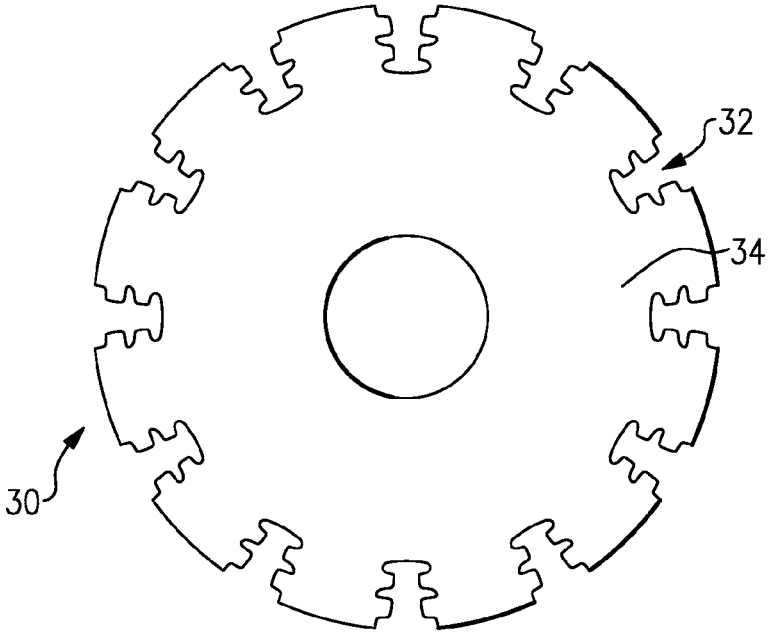
FIG. 2 illustrates an example structural component having a protective coating.

FIG. 2 illustrates a structural component that may be used in the example gas turbine engine 10 to mount blades, such as the turbine blades 22. In this case, the component is a disk 30 or rotor that is made of a superalloy material, such as a nickel-based superalloy. The disk 30 includes mounting locations 32, such as slots, for securing the blades 22 to the disk 30, however, the disk may be an integrally bladed rotor or other type of disk. Alternatively, the structural component may be a compressor disk for mounting compressor blades within the compressor section 16 of the engine 10, integrally bladed rotor, seal, shaft, spacer, airfoil, impeller, or other turbine engine apparatus. Given this description, one of ordinary skill in the art will recognize other types of structural components that would benefit from the examples disclosed herein.

The superalloy material of the disk 30 may be selected from nickel-based, cobalt-based and iron-based superalloys, and is generally a different composition that is used for the turbine blades 22, for example. As an example, the superalloy of the disk 30 is designed to withstand the extreme high temperature environment and high stress conditions of the gas turbine engine 10. In this regard, the compositions that are typically used for the disk 30 are designed to resist fatigue and other environmental conditions (e.g., oxidation conditions, hot corrosion, etc.).

As the design temperatures of the engine 10 become more severe, the superalloys for the disk 30 are also designed with compositions intended to withstand such conditions. However, a protective coating 34 as disclosed herein may also be used to enhance the environmental resistance of the disk 30, without debit to the fatigue or other properties of the disk 30. In this regard, the composition of the protective coating 34 is designed to cooperate with the superalloy composition of the disk 30 to facilitate reduction of fatigue impact on the disk 30. That is, the protective coating 34 reduces or eliminates any debit to the fatigue life properties of the disk 30. Table 1 below discloses example alloys for the structural component or disk 30.

| Alloy Name | Nickel | Aluminum | Titanium | Tantalum | Chromium | Cobalt | Molybdenum | Tungsten | Niobium | Iron | Manganese | Silicon | Carbon | Boron | Zirconium | Other | Density, lb/in$^3$ | Precipitation Hardenable |
|---|---|---|---|---|---|---|---|---|---|---|---|---|---|---|---|---|---|---|
| AF115 | 63.88 | 3.8 | 3.9 | | 10.5 | 15 | 2.8 | 5.9 | 1.8 | | | | 0.05 | 0.02 | 0.05 | 0.8Hf | | Y |
| Alloy 10 | 63.74 | 3.7 | 3.8 | 0.9 | 10.2 | 15 | 2.8 | 6.2 | 1.9 | | | | 0.03 | 0.03 | 0.1 | | 0.302 | Y |
| Astroloy | 55.00 | 4 | 3.5 | | 15 | 17 | 5.3 | | | | | | 0.06 | 0.03 | | | 0.286 | Y |
| Cabot 214 | 75.00 | 4.5 | | | 16 | | | | | 2.5 | | | | | | 0.01Y | 0.291 | Y |
| CH 98 Nominal | 77.585 | 3.95 | 9.95 | 3.8-4.0 | 11.9 | 17.85 | 3.95 | | | | | | 0.03 | 0.35 | 0.235 | | | Y |
| D-979 | 45.00 | 1 | 3 | | 15 | | 4 | | | 27 | 0.3 | 0.2 | 0.05 | 0.01 | | | 0.296 | N |
| EP741NP | 65.48 | 5.1 | 1.8 | | 9 | 15.8 | 3.9 | 5.5 | | | | | 0.04 | <0.015 | <0.015 | 0.25Hf | | Y |
| Gator Waspaloy | 66.19 | 2.2 | 4.6 | | 16 | 13.6 | 4.1 | | | | | | 0.03 | 0.007 | 0.07 | | 0.299 | Y |
| Hastelloy C-22 | 51.60 | | | | 21.5 | 2.5 | 13.5 | 4 | | 5.5 | 1 | 0.1 | 0.01 | | | 0.3V | 0.314 | N |
| Hastelloy G-30 | 40.67 | | | | 29.5 | 2 | 5.5 | 2.5 | 0.8 | 15 | 1 | 1 | 0.03 | | | 2.0Cu | 0.297 | N |
| Hastelloy S | 42.70 | 0.3 | | | 15.5 | | 14.5 | | | 1 | 0.5 | 0.4 | | 0.009 | | 0.05La | 0.316 | N |
| Hastelloy X | 67.00 | | | | 22 | 1.5 | 9 | 0.6 | | 18.5 | 0.5 | 0.5 | 0.1 | | | | 0.297 | N |
| Haynes 230 | 47.00 | 0.3 | | | 22 | | 2 | 14 | | | 0.5 | 0.4 | 0.1 | | | 0.02La | 0.319 | N |
| IN-100 | 57.00 | 5 | 4.3 | | 12.4 | 18.5 | 3.2 | | | | | | 0.07 | 0.02 | 0.06 | 0.8V | 0.284 | Y |
| Inconel 600 | 55.80 | | | | 15.5 | | | | | 8 | 0.5 | 0.2 | 0.08 | | | | 0.304 | N |
| Inconel 601 | 76.00 | 1.4 | | | 23 | | | | | 14.1 | 0.5 | 0.2 | 0.05 | | | | 0.291 | N |
| Inconel 617 | 60.50 | 1 | 0.3 | | 22 | 12.5 | 9 | | | | | | 0.07 | | | | 0.302 | N |
| Inconel 625 | 54.00 | 0.2 | 0.2 | | 21.5 | | 9 | | 3.6 | 2.5 | 0.2 | 0.2 | 0.05 | | | | 0.305 | N |
| Inconel 706 | 41.50 | 0.2 | 1.8 | | 16 | | | | 2.9 | 40 | 0.2 | 0.2 | 0.03 | | | | 0.292 | N |
| Inconel 718 | 52.50 | 0.5 | 0.9 | | 19 | | | | 5.1 | 18.5 | 0.2 | 0.2 | 0.04 | | | | 0.297 | Y |
| Inconel MA 6000 | 69.00 | 4.5 | 2.5 | 2 | 15 | | 2 | 4 | | | | | 0.05 | 0.01 | 0.15 | 2.5$Y_2O_3$ | 0.293 | Y |
| Inconel MA 754 | 78.00 | 0.3 | 0.5 | | 20 | | | | | | | | 0.05 | | | 0.6$Y_2O_3$ | 0.300 | N |
| Inconel X-750 | 73.00 | 0.7 | 2.5 | | 15.5 | | | | 1 | 7 | 0.5 | 0.2 | 0.04 | | | | 0.298 | Y |
| KM4 | 63.91 | 4 | 4 | | 12 | 18 | 4 | | 2 | | | | 0.03 | 0.03 | 0.03 | | | Y |
| LSHR | 58.19 | 3.5 | 3.5 | 1.6 | 12.5 | 20.7 | 2.7 | 4.3 | 1.5 | | | | 0.03 | 0.03 | 0.05 | | 0.302 | Y |
| M-252 | 55.00 | 1 | 2.6 | | 20 | 10 | 10 | | | | 0.5 | 0.5 | 0.15 | 0.005 | | | 0.298 | Y |
| ME16 | 59.47 | 3.4 | 3.7 | 2.4 | 13 | 20.6 | 3.8 | 2.1 | 0.9 | | | | 0.05 | 0.03 | 0.05 | | 0.299 | Y |
| Merl 76 | 64.06 | 5 | 4.3 | | 12.4 | 18.5 | 3.2 | | 1.4 | | | | 0.025 | 0.02 | | 0.4Hf | 0.286 | Y |
| NF3 | 63.49 | 3.6 | 3.6 | 2.5 | 10.5 | 18 | 2.9 | 3 | 2 | | | | 0.03 | 0.03 | 0.05 | | 0.299 | Y |
| Nimonic 105 | 53.00 | 4.7 | 1.2 | | 15 | 20 | 5 | | | | 0.3 | 0.3 | 0.13 | 0.005 | 0.1 | | 0.289 | Y |
| Nimonic 115 | 60.00 | 4.9 | 3.7 | | 14.3 | 13.2 | | | | | | | 0.15 | 0.16 | 0.04 | | 0.284 | Y |
| Nimonic 263 | 51.00 | 0.5 | 2.1 | | 20 | 20 | 5.9 | | | | 0.4 | 0.3 | 0.06 | 0.001 | 0.02 | | 0.302 | Y |
| Nimonic 75 | 76.00 | | 0.4 | | 19.5 | | | | | 3 | 0.3 | 0.3 | 0.1 | | | | 0.302 | Y |
| Nimonic 80A | 76.00 | 1.4 | 2.4 | | 19.5 | | | | | | 0.3 | 0.3 | 0.06 | 0.003 | 0.06 | | 0.295 | Y |
| Nimonic 90 | 59.00 | 1.5 | 2.5 | | 19.5 | 16.5 | | | | | 0.3 | 0.3 | 0.07 | 0.003 | 0.06 | | 0.296 | Y |
| Nimonic PE.16 | 43.00 | 1.2 | 1.2 | | 16.5 | 1 | 1.1 | | | 33 | 0.1 | 0.1 | 0.05 | 0.02 | | | 0.290 | N |
| Nimonic PK.33 | 56.00 | 2 | 2 | | 18.5 | 14 | 7 | | | 0.3 | 0.1 | 0.1 | 0.05 | 0.03 | | | 0.297 | Y |
| NR3 (Onera) | 69.83 | 3.65 | 5.5 | | 11.8 | 14.65 | 3.3 | | | | | | 0.024 | 0.013 | 0.052 | 0.33HF | | Y |

-continued

| Alloy Name | Nickel | Aluminum | Titanium | Tantalum | Chromium | Cobalt | Molybdenum | Tungsten | Niobium | Iron | Manganese | Silicon | Carbon | Boron | Zirconium | Other | Density, lb/in$^3$ | Precipitation Hardenable |
|---|---|---|---|---|---|---|---|---|---|---|---|---|---|---|---|---|---|---|
| P/M U720 | 65.49 | 2.55 | 5.05 | | 15.6 | 14.6 | 3 | 1.24 | | | | | 0.008 | 0.03 | 0.03 | | | Y |
| Rene 104 | 61.22 | 3.5 | 4.5 | 2.25 | 13 | 18.5 | 3.85 | 1.75 | 1.625 | | | | 0.0575 | | | | | Y |
| Rene 41 | 55.00 | 1.5 | 3.1 | | 19 | 11 | 10 | | | | | | 0.09 | 0.005 | | | 0.298 | Y |
| Rene 88 | 62.26 | 2.1 | 3.7 | | 16 | 13 | 4 | 4 | 0.7 | | | | 0.03 | 0.015 | | | | Y |
| Rene 95 | 61.00 | 3.5 | 2.5 | | 14 | 8 | 3.5 | 3.5 | 3.5 | | | | 0.15 | 0.01 | 0.05 | | 0.297 | Y |
| RR1000 | 63.40 | 3 | 3.8 | 1.75 | 14.75 | 16.5 | 4.75 | | | | | | 0.0225 | 0.018 | 0.06 | 0.5 HF | | Y |
| SR3 | 68.03 | 2.6 | 4.9 | | 13 | 12 | 5.1 | | 1.6 | | | | 0.03 | 0.015 | 0.03 | 0.2Hf | | Y |
| TD Nickel | 98.00 | | | | | | | | | | | | | | | 2.0$ThO_2$ | 0.322 | N |
| U720 LI | 65.93 | 2.5 | 5 | | 16 | 15 | 3 | | | | | | 0.025 | 0.018 | 0.03 | | | Y |
| Udimet 500 | 54.00 | 2.9 | 2.9 | | 18 | 18.5 | 4 | | | | | | 0.08 | 0.006 | 0.05 | | 0.290 | Y |
| Udimet 520 | 57.00 | 2 | 3 | | 19 | 12 | 6 | 1 | | | | | 0.05 | 0.005 | | | 0.292 | Y |
| Udimet 700 | 55.00 | 4 | 3.5 | | 15 | 17 | 5 | | | | | | 0.06 | 0.03 | | | 0.286 | Y |
| Udimet 710 | 55.00 | 2.5 | 5 | | 18 | 15 | 3 | 1.5 | | | | | 0.07 | 0.02 | | | 0.292 | Y |
| Udimet 720 | 55.00 | 2.5 | 5 | | 17.9 | 14.7 | 3 | 1.3 | | | | | 0.03 | 0.033 | 0.03 | | 0.292 | Y |
| Unitemp AF2-1DA | 59.00 | 4.6 | 3 | 1.5 | 12 | 10 | 3 | 6 | | 1 | | | 0.35 | 0.014 | 0.1 | | 0.299 | Y |
| Unitemp AF2-1DA | 60.00 | 4 | 2.8 | 1.5 | 12 | 10 | 2.7 | 6.5 | | | | | 0.04 | 0.015 | 0.1 | | 0.301 | Y |
| Waspaloy | 58.00 | 1.3 | 3 | | 19.5 | 13.5 | 4.3 | | | | | | 0.08 | 0.006 | | | 0.296 | Y |

The protective coating 34 may be used alone or in combination with other coatings. Generally, the protective coating 34 may be used alone and is a relatively thin layer of uniform thickness that is deposited onto a portion or all of the surfaces of the disk 30.

The composition of the protective coating 34 is selected to appropriately match the properties of the superalloy of the disk 30 or other structural component formed from one of the alloys in Table 1, for example. For instance, the coefficient of thermal expansion of the protective coating 34 closely matches the coefficient of thermal expansion of the superalloy material of the disk 30. The composition of the protective coating 34 may also be chemically designed for ductility over a wide range of temperatures. By controlling the thickness of the protective coating 34 and depositing the coating using physical vapor deposition (e.g., cathodic arc coating or ion plasma deposition), the mechanical fatigue limits imposed by the coating may be eliminated or reduced significantly.

The broad composition of the protective coating 34 consists essentially of up to 30 wt % cobalt, 5-40 wt % chromium, 7.5-35 wt % aluminum, up to 6 wt % tantalum, up to 1.7 wt % molybdenum, up to 3 wt % rhenium, up to 5 wt % tungsten, up to 2 wt % yttrium, 0.05-2 wt % hafnium, 0.05-7 wt % silicon, 0.01-0.1 wt % zirconium, and a balance of nickel. The compositions disclosed herein may include impurities that do not affect the properties of the coating or elements that are unmeasured or undetectable in the coating. Additionally, the disclosed compositions do not include any other elements that are present in more than trace amounts as inadvertent impurities.

Within the broad composition disclosed above, the protective coating 34 may generally have a gamma/beta composition or a gamma/gamma prime composition, which are differentiated primarily by the amounts of chromium, aluminum, and reactive elements within the compositions. As an example, the gamma/beta family of compositions may consist essentially of 0.0-30.0 wt % cobalt, 5-40 wt % chromium, 8.0-35.0 wt % aluminum, up to 5 wt % tantalum, up to 1 wt % molybdenum, up to 2 wt % rhenium, up to 5 wt % tungsten, up to 2 wt % yttrium, 0.1-2.0 wt % hafnium, 0.1-7 wt % silicon, 0.01-0.1 wt % zirconium, and a balance of nickel. The gamma/gamma prime family of compositions may generally include 10.0-14.0 wt % cobalt, 5.5-14.0 wt % chromium, 7.5-11.0 wt % aluminum, up to 6 wt % tantalum, up to 1.7 wt % molybdenum, up to 3 wt % rhenium, up to 5 wt % tungsten, 0.05-1.0 wt % yttrium, 0.05-1.0 wt % hafnium, 0.05-1.0 wt % silicon, 0.01-0.1 wt % zirconium, and a balance of nickel.

Within the gamma/beta composition family, one example composition may consist essentially of up to 24 wt % cobalt, 14.0-34.5 wt % chromium, 4.0-12.5 wt % aluminum, up to 1 wt % yttrium, up to 1 wt % hafnium, 0.1-2.5 wt % silicon, 0.01-0.1 wt % zirconium, and a balance of nickel. Another example composition may consist essentially of up to 24 wt % cobalt, 14.0-34.5 wt % chromium, 4.0-12.5 wt % aluminum, up to 5 wt % tantalum, up to 1 wt % molybdenum, up to 2 wt % rhenium, up to 5 wt % tungsten, up to 1 wt % yttrium, up to 1 wt % hafnium, 0.1-2.5 wt % silicon, 0.01-0.1 wt % zirconium, and a balance of nickel. Notably, the former composition does not include the refractory elements of tantalum, molybdenum, rhenium, or tungsten. The latter composition may include up to approximately 12 wt % of the refractory elements. Thus, depending upon the composition of the superalloy of the disk 30, the composition of the protective coating 34 may be selected to either include or exclude refractory elements to match the superalloy disk coefficient of thermal expansion properties.

In further examples of compositions from the gamma/beta composition family that do not include the refractory elements, the composition of the protective coating 34 may consist essentially of about 22 wt % cobalt, about 16 wt % chromium, about 12.3 wt % aluminum, about 0.6 wt % yttrium, about 0.3 wt % hafnium, about 0.5 wt % silicon, about 0.1 wt % zirconium, and a balance of nickel, or consist essentially of about 17 wt % cobalt, about 32 wt % chromium, about 7.7 wt % aluminum, about 0.5 wt % yttrium, about 0.3 wt % hafnium, about 0.4 wt % silicon, about 0.1 wt % zirconium, and a balance of nickel. The latter composition has good hot corrosion resistance, due to the high chromium content, and has good compatibility with various nickel-based superalloys. The term "about" as used in this description relative to compositions refers to variation in the given value, such as normally accepted variations or tolerances.

In further examples of compositions from the gamma/beta composition family that do include the refractory elements, the composition of the protective coating 34 may consist essentially of about 3.0 wt % cobalt, about 24.3 wt % chromium, about 6.0 wt % aluminum, about 3.0 wt % tantalum, about 0.5 wt % molybdenum, about 1.5 wt % rhenium, about 3.0 wt % tungsten, about 0.1 wt % yttrium, about 0.8 wt % hafnium, about 1.5 wt % silicon, about 0.1 wt % zirconium, and a balance of nickel. In this case, the refractory elements are provided in specific ratios that are tailored to the disk 30 superalloy coefficient of thermal expansion. For instance, the ratio of tantalum to rhenium is generally 0.1-10. In another example, the ratio is 1-3 or even approximately 2. In one case, the ratio of tantalum/molybdenum/rhenium/tungsten is 6:1:3:6. In further examples, the ratio of tungsten to rhenium is 2, and the ratio of molybdenum to rhenium is 0.33.

Within the gamma/gamma prime composition family, the composition of the protective coating 34 may either include refractory elements or exclude the refractory elements. As an example of a composition that excludes the refractory elements, the composition may consist essentially of 10.0-13.0 wt % cobalt, 5.5-7.0 wt % chromium, 9.0-11.0 wt % aluminum, 3.0-6.0 wt % tantalum, 1.1-1.7 wt % molybdenum, up to 3 wt % rhenium, 3.0-5.0 wt % tungsten, 0.3-0.7 wt % yttrium, 0.2-0.6 wt % hafnium, 0.1-0.03 wt % silicon, 0.1-0.2 wt % zirconium, and a balance of nickel. As an example of a composition that includes the refractory elements, the composition may consist essentially of 10.0-13.0 wt % cobalt, 5.5-7.0 wt % chromium, 9.0-11.0 wt % aluminum, 3.0-6.0 wt % tantalum, 1.1-1.7 wt % molybdenum, up to 3 wt % rhenium, 3.0-5.0 wt % tungsten, 0.3-0.7 wt % yttrium, 0.2-0.6 wt % hafnium, 0.1-0.3 wt % silicon, 0.1-0.2 wt % zirconium, and a balance of nickel. In the former composition, the amount of yttrium is greater than the amount of zirconium. In the latter composition that includes refractory elements, the amount of aluminum is greater than the amount of chromium. These examples show how the various coating constituents can vary to match the CTE and still provide sufficient environmental protection. The amount of refractory elements may also total up to approximately 16 wt %.

In further examples of compositions from the gamma/gamma prime composition family that do not include the refractory elements, the composition may consist essentially of about 12.5 wt % cobalt, about 12.5 wt % chromium, about 8.3 wt % aluminum, about 0.4 wt % yttrium, about 0.3 wt % hafnium, about 0.1 wt % silicon, about 0.01-0.1 wt % zirconium, and a balance of nickel. In further examples of compositions from the gamma/gamma prime composition family that do include the refractory elements, the composition may consist essentially of about 11.5 wt % cobalt, about 6.3 wt % chromium, about 10.0 wt % aluminum, about 4.5 wt % tantalum, about 1.4 wt % molybdenum, up to 3 wt % rhenium, about 3.7 wt % tungsten, about 0.5 wt % yttrium, about 0.4 wt % hafnium, about 0.2 wt % silicon, 0.01-0.1 wt % zirconium, and a balance of nickel. In the latter composition that includes the refractory elements, the amount of aluminum is greater than the amount of chromium, and the amounts of silicon, hafnium, and yttrium are all greater than the amount of zirconium. Additionally, there is at least 2.5 times more yttrium that silicon. In the case of the composition that does not include the refractory elements, there is approximately four times more yttrium than silicon. The example compositions and ratios are designed to closely match the coefficient of thermal expansion of the superalloy while providing environmental protection of the disk 30.

The protective coating 34 may be deposited by physical vapor deposition onto the underlying superalloy of the disk 30. Following deposition, the disk 30 and protective coating 34 may be subjected to a diffusion heat treatment at a temperature of around 1975° F. for four hours. Alternatively, the diffusion heat treatment temperature and time may be modified, depending upon the particular needs of an intended end use application. In another alternative, the disk 30 and protective coating 34 may not be subjected to any diffusion heat treatment. In this case, the deposition process may be modified accordingly. For example, the surfaces of the disk 30 may be treated by ion bombardment as a cleaning step to prepare the disk 30 for deposition of the protective coating 34. If no diffusion heat treatment is to be used, the ion bombardment time may be extended to ensure that the surfaces are clean for good bonding between the protective coating 34 and the disk 30.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A turbine engine apparatus comprising:

a rotor disk made of a superalloy material; and a protective coating disposed on the rotor disk, the protective coating having a composition in accordance with the composition of the superalloy material of the rotor disk such that fatigue of the rotor disk is not debited, the composition of the protective coating consisting essentially of up to 30 wt % cobalt, 5-40 wt % chromium, 4.0-35 wt % aluminum, up to 6 wt % tantalum, up to 1.7 wt % molybdenum, up to 3 wt % rhenium, up to 5 wt % tungsten, up to 2 wt % yttrium, up to 2 wt % hafnium, 0.05-7 wt % silicon, 0.01-0.2 wt % zirconium, and a balance of nickel.

2. The turbine engine apparatus as recited in claim 1, wherein the composition includes rhenium.

3. The turbine engine apparatus as recited in claim 1, wherein the composition includes tantalum and rhenium in a Ta/Re ratio of 0.1-10.

4. The turbine engine apparatus as recited in claim 3, wherein the Ta/Re ratio is 1-3.

5. The turbine engine apparatus as recited in claim 4, wherein the Ta/Re ratio is 2.

6. The turbine engine apparatus as recited in claim 1, wherein the composition includes tantalum, molybdenum, rhenium and tungsten in a Ta/Mo/Re/W ratio of 6:1:3:6.

7. The turbine engine apparatus as recited in claim 1, wherein the composition includes tungsten and rhenium in a W/Re ratio of 2.

8. The turbine engine apparatus as recited in claim 1, wherein the composition includes molybdenum and rhenium in a Mo/Re ratio of 0.33.

9. The turbine engine apparatus as recited in claim 1, wherein the composition consists essentially of 0.0-30.0 wt % cobalt, 5-40 wt % chromium, 8.0-35.0 wt % aluminum, up to 5 wt % tantalum, up to 1 wt % molybdenum, up to 2 wt % rhenium, up to 5 wt % tungsten, up to 2 wt % yttrium, 0.1-2.0 wt % hafnium, 0.1-7 wt % silicon, 0.01-0.1 wt % zirconium, and a balance of nickel.

10. The turbine engine apparatus as recited in claim 1, wherein the composition consists essentially of 10.0-14.0 wt % cobalt, 5.5-14.0 wt % chromium, 7.5-11.0 wt % aluminum, up to 6 wt % tantalum, up to 1.7 wt % molybdenum, up to 3 wt % rhenium, up to 5 wt % tungsten, 0.05-1.0 wt % yttrium, 0.05-1.0 wt % hafnium, 0.05-1.0 wt % silicon, 0.01-0.1 wt % zirconium, and a balance of nickel.

11. The turbine engine apparatus as recited in claim 1, wherein the composition consists essentially of up to 24 wt % cobalt, 14.0-34.5 wt % chromium, 4.0-12.5 wt % aluminum, up to 1 wt % yttrium, up to 1 wt % hafnium, 0.1-2.5 wt % silicon, 0.01-0.1 wt % zirconium, and a balance of nickel.

12. The turbine engine apparatus as recited in claim 1, wherein the composition consists essentially of up to 24 wt % cobalt, 14.0-34.5 wt % chromium, 4.0-12.5 wt % aluminum, up to 5 wt % tantalum, up to 1 wt % molybdenum, up to 2 wt % rhenium, up to 5 wt % tungsten, up to 1 wt % yttrium, up to 1 wt % hafnium, 0.1-2.5 wt % silicon, 0.01-0.1 wt % zirconium, and a balance of nickel.

13. The turbine engine apparatus as recited in claim 1, wherein the composition consists essentially of about 22 wt % cobalt, about 16 wt % chromium, about 12.3 wt % aluminum, about 0.6 wt % yttrium, about 0.3 wt % hafnium, about 0.5 wt % silicon, about 0.1 wt % zirconium, and a balance of nickel.

14. The turbine engine apparatus as recited in claim 1, wherein the composition consists essentially of about 17 wt % cobalt, about 32 wt % chromium, about 7.7 wt % aluminum, about 0.5 wt % yttrium, about 0.3 wt % hafnium, about 0.4 wt % silicon, about 0.1 wt % zirconium, and a balance of nickel.

15. The turbine engine apparatus as recited in claim 1, wherein the composition consists essentially of about 3.0 wt % cobalt, about 24.3 wt % chromium, about 6.0 wt % aluminum, about 3.0 wt % tantalum, about 0.5 wt % molybdenum, about 1.5 wt % rhenium, about 3.0 wt % tungsten, about 0.1 wt % yttrium, about 0.8 wt % hafnium, about 1.5 wt % silicon, about 0.1 wt % zirconium, and a balance of nickel.

16. The turbine engine apparatus as recited in claim 1, wherein the composition consists essentially of 11.0-14.0 wt % cobalt, 11.0-14.0 wt % chromium, 7.5-9.5 wt % aluminum, 0.2-0.6 wt % yttrium, 0.1-0.5 wt % hafnium, 0.1-0.3 wt % silicon, 0.1-0.2 wt % zirconium, and a balance of nickel.

17. The turbine engine apparatus as recited in claim 1, wherein the composition consists essentially of 10.0-13.0 wt % cobalt, 5.5-7.0 wt % chromium, 9.0-11.0 wt % aluminum, 3.0-6.0 wt % tantalum, 1.1-1.7 wt % molybdenum, up to 3 wt % rhenium, 3.0-5.0 wt % tungsten, 0.3-0.7 wt % yttrium, 0.2-0.6 wt % hafnium, 0.1-0.3 wt % silicon, 0.1-0.2 wt % zirconium, and a balance of nickel.

18. The turbine engine apparatus as recited in claim 1, wherein the composition consists essentially of about 12.5 wt % cobalt, about 12.5 wt % chromium, about 8.3 wt % aluminum, about 0.4 wt % yttrium, about 0.3 wt % hafnium, about 0.1 wt % silicon, about 0.01-0.1 wt % zirconium, and a balance of nickel.

19. The turbine engine apparatus as recited in claim 1, wherein the composition consists essentially of about 11.5 wt % cobalt, about 6.3 wt % chromium, about 10.0 wt % aluminum, about 4.5 wt % tantalum, about 1.4 wt % molybdenum, up to 3 wt % rhenium, about 3.7 wt % tungsten, about 0.5 wt % yttrium, about 0.4 wt % hafnium, about 0.2 wt % silicon, 0.01-0.1 wt % zirconium, and a balance of nickel.

20. The turbine engine apparatus as recited in claim 1, wherein the amount of aluminum is greater than the amount of chromium, wherein the amounts of silicon, hafnium, and yttrium are each greater than the amount of zirconium, and the composition includes at least 2.5 times more yttrium than silicon.

21. The turbine engine apparatus as recited in claim 1, wherein the rotor disk is a compressor disk.

22. The turbine engine apparatus as recited in claim 1, wherein the composition consists essentially of up to 30 wt % cobalt, 32-40 wt % chromium, 4.0-35 wt % aluminum, up to 6 wt % tantalum, up to 1.7 wt % molybdenum, up to 3 wt % rhenium, up to 5 wt % tungsten, up to 2 wt % yttrium, up to 2 wt % hafnium, 0.05-7 wt % silicon, 0.01-0.2 wt % zirconium, and a balance of nickel.

23. The turbine engine apparatus as recited in claim 1, wherein the composition consists essentially of up to 30 wt % cobalt, 24.3-40 wt % chromium, 4.0-35 wt % aluminum, up to 6 wt % tantalum, up to 1.7 wt % molybdenum, up to 3 wt % rhenium, up to 5 wt % tungsten, up to 2 wt % yttrium, up to 2 wt % hafnium, 0.05-7 wt % silicon, 0.01-0.2 wt % zirconium, and a balance of nickel.

24. The turbine engine apparatus as recited in claim 1, wherein the rotor disk includes circumferentially-spaced slots around its periphery.

25. The turbine engine apparatus as recited in claim 1, wherein the rotor disk includes circumferentially-spaced blades around its periphery.

* * * * *